US007942281B2

(12) United States Patent
Bloom et al.

(10) Patent No.: US 7,942,281 B2
(45) Date of Patent: May 17, 2011

(54) CLOSURE AND PACKAGE WITH FLEXIBLE BASE WALL PANEL

(75) Inventors: Kenneth S. Bloom, Bloomdale, OH (US); Terry D. Patcheak, Ypsilanti, MI (US)

(73) Assignee: Rexam Closure Systems, Inc., Perrysburg, OH (US)

( * ) Notice: Subject to any disclaimer, the term of this patent is extended or adjusted under 35 U.S.C. 154(b) by 919 days.

(21) Appl. No.: 11/729,572

(22) Filed: Mar. 29, 2007

(65) Prior Publication Data

US 2008/0237238 A1 Oct. 2, 2008

(51) Int. Cl.
*B65D 53/00* (2006.01)
*B65D 41/04* (2006.01)

(52) U.S. Cl. ..... 215/341; 215/316; 215/329; 220/378; 220/288

(58) Field of Classification Search ..... 215/341, 215/316, 317, 329; 220/378, 288
See application file for complete search history.

(56) References Cited

U.S. PATENT DOCUMENTS

| | | | | |
|---|---|---|---|---|
| 1,381,365 | A | 6/1921 | Taliaferro | |
| 1,515,560 | A | 11/1924 | Elwell | |
| 1,645,158 | A | 10/1927 | Russell | |
| 2,079,320 | A | 5/1937 | Kalber | |
| 3,160,303 | A * | 12/1964 | Healy | 215/344 |
| 3,235,114 | A | 2/1966 | Blackwood et al. | |
| 3,780,898 | A | 12/1973 | Menkel | |
| 4,044,941 | A * | 8/1977 | Knudsen | 220/258.3 |
| 4,078,696 | A * | 3/1978 | Crisci | 220/795 |
| 4,244,481 | A * | 1/1981 | Kornelis | 215/348 |
| 4,585,135 | A | 4/1986 | Sinnott | |
| 4,668,458 | A | 5/1987 | Whitney | |
| 6,378,715 | B1 * | 4/2002 | Finkelstein et al. | 215/341 |
| 6,702,133 | B1 | 3/2004 | Shenkar et al. | |
| 2003/0098286 | A1 | 5/2003 | Bloom et al. | |

FOREIGN PATENT DOCUMENTS

| | | |
|---|---|---|
| DE | 29 29 735 | 2/1980 |
| EP | 0389815 | 2/1990 |
| GB | 2068914 | 8/1981 |

* cited by examiner

*Primary Examiner* — Robin A. Hylton
(74) *Attorney, Agent, or Firm* — Reising Ethington PC

(57) ABSTRACT

A closure includes a plastic shell having a generally flat base wall, a peripheral skirt for mounting the closure on a container neck finish and an annular portion integrally connecting the skirt to the periphery of the base wall. A flexible resilient sealing liner is disposed on at least an inner surface of the annular portion. The annular portion has an inverted V-shape with an outer leg integrally connected to the skirt and an inner leg integrally connected to the periphery of the base wall such that the base wall is disposed axially beneath the annular connection between the inner and outer legs. The inner leg is resiliently flexible with respect to the outer leg upon engagement with an end of a container neck finish so as to flex the inner leg and the base wall outwardly with respect to the skirt and thereby draw the outer leg into engagement with an outer surface of the container neck finish. The inner leg of the annular V-shaped portion preferably is conical, and in exemplary embodiments of the disclosure the outer leg preferably either is cylindrical or is conical preferably at an angle equal and opposite to the conical inner leg.

13 Claims, 3 Drawing Sheets

CLOSURE AND PACKAGE WITH FLEXIBLE BASE WALL PANEL

The present disclosure is directed to a closure having a flexible base wall panel for enhancing sealing engagement with a container neck finish, and to a package that includes such a closure.

BACKGROUND AND SUMMARY OF THE INVENTION

A general object of the present disclosure is to provide a closure having a flexible panel in the closure base wall to maintain and enhance sealing engagement with a container neck finish in either an internal pressure application or an internal vacuum application.

The present disclosure embodies a number of aspects that can be implemented separately from or in combination with each other.

A closure in accordance with one aspect of the present disclosure includes a plastic shell having a generally flat base wall, a peripheral skirt for mounting the closure on a container neck finish and an annular portion integrally connecting the skirt to the periphery of the base wall. A flexible resilient sealing liner is disposed on at least an inner surface of the annular portion. The annular portion has an inverted V-shape with an outer leg integrally connected to the skirt and an inner leg integrally connected to the periphery of the base wall such that the base wall is disposed axially beneath the annular connection between the inner and outer legs. The inner leg is resiliently flexible with respect to the outer leg upon engagement with an end of a container neck finish so as to flex the inner leg and the base wall outwardly with respect to the skirt and thereby draw the outer leg into engagement with an outer surface of the container neck finish. The inner leg of the annular V-shaped portion preferably is conical, and in exemplary embodiments of the disclosure the outer leg preferably either is cylindrical or is conical preferably at an angle equal and opposite to the conical inner leg. The sealing liner preferably extends over the undersurface of the closure base wall.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
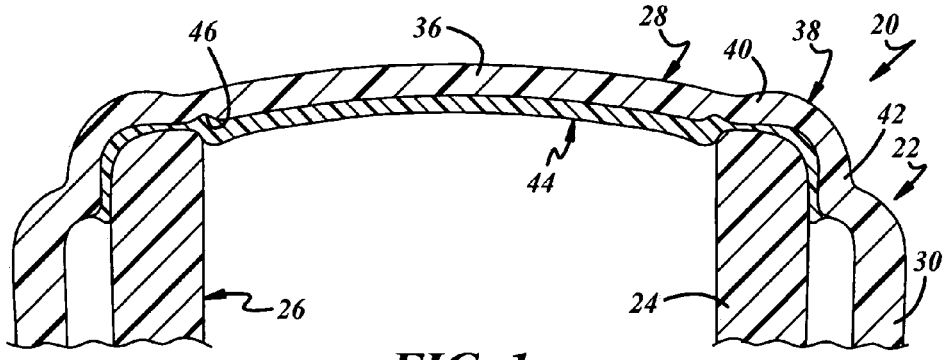
FIG. 1 is a fragmentary sectional view of a package in accordance with a first exemplary embodiment of the present disclosure.
Figure 2:
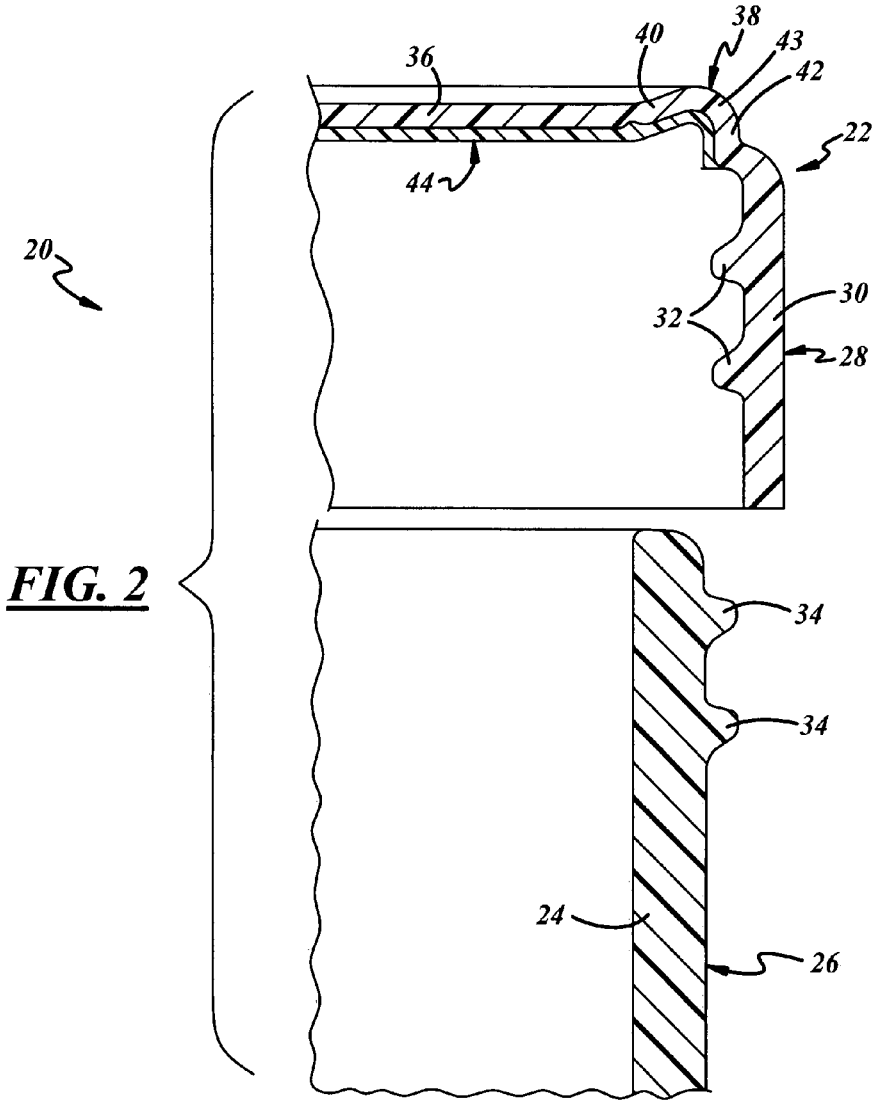
FIG. 2 is a fragmentary exploded sectional view of the package in FIG. 1.
Figure 3:
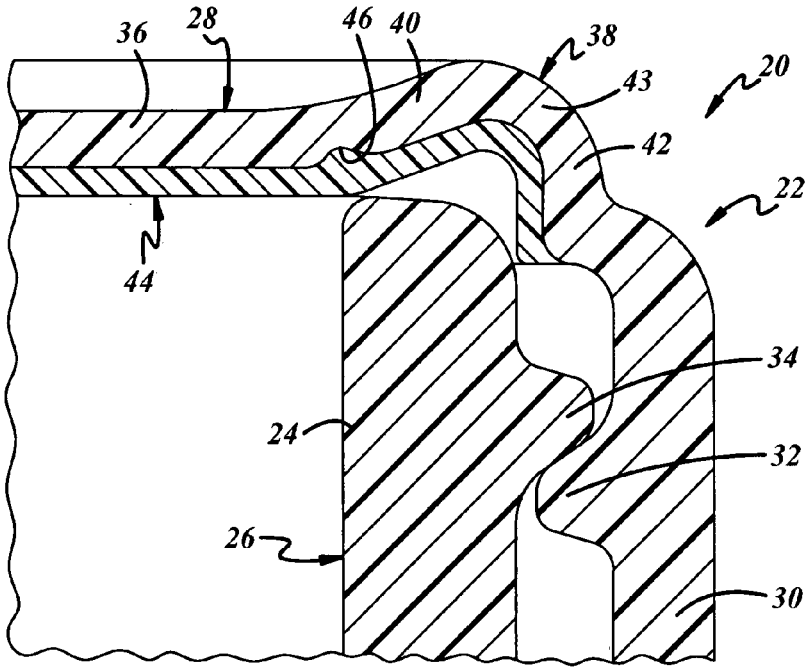
FIG. 3 is a fragmentary sectional view of the package in FIGS. 1 and 2 with the closure partially threaded onto the container neck finish.

FIGS. 1-3 illustrate a package 20 in accordance with one exemplary embodiment of the present disclosure as including a closure 22 applied to the neck finish 24 of a container 26. Closure 22 includes a one-piece plastic shell 28 having a skirt 30 with one or more internal thread segments 32 for threaded engagement with one or more external thread segments 34 on container neck finish 24 to secure closure 22 on container 26. (The term "thread segments" is employed in its usual broad sense to include both continuous and discontinuous threads, and to include both single and multiple threads.) Closure shell 28 also includes a generally flat base wall 36. (The term "generally flat" means that the base wall 36 is flat in closure shell 28 as manufactured within normal manufacturing tolerances.) The outer periphery of base wall 36, which is generally circular, is integrally connected to skirt 30 by an annular portion 38 having an inverted V-shaped geometry in cross section. An inner leg 40 of portion 38 is integrally connected with the periphery of base wall 36, and an outer leg 42 of portion 38 is integrally connected with the edge of skirt 30 adjacent to base wall 36. It will be noted in FIGS. 2 and 3 that, in closure shell 28 as manufactured, generally flat base wall 36 is disposed beneath the juncture of inner and outer legs 40,42. which forms the apex 43 of inverted V-shaped portion 38. Inner leg 40 preferably is conical and outer leg 42 is cylindrical in this embodiment and coaxial with skirt 30.

A flexible resilient sealing liner 44 is disposed at least on the inner or undersurface of annular portion 38. Liner 44 preferably also extends over the entire undersurface of base wall 36. There is an annular channel 46 in this embodiment on the undersurface of closure shell 28 at the juncture of base wall 36 and inner leg 40. This channel 46 preferably is filled with the material of liner 44. Liner 44 can be of any suitable flexible resilient resin construction either with or without active and/or passive barrier properties. Closure 22 and/or container 26 can include suitable tamper-indicating structure to indicate that the package has been opened and/or suitable child-resistance structure to impede opening of the package by a child. Container 26 can be of glass or, more preferably, plastic construction. Liner 44 preferably is molded in situ onto closure shell 28.

As closure 22 is threaded onto container neck finish 24, the inside edge of neck finish 24 contacts liner 44 at about the juncture of base wall 36 and leg 40, as best seen in FIG. 3. Further threading of the closure onto the neck finish flexes leg 40 and base wall 36 axially outwardly to the configuration illustrated in FIG. 1. This outward flexing of base wall 36 and leg 40 around apex 43 draws outer leg 42 radially inwardly to urge the portion of liner 44 inside of leg 42 into radial sealing engagement with an outer surface of neck finish 24, as illustrated in FIG. 1. Provision of channel 46 helps urge liner 44 into sealing engagement with the inside edge of neck finish 24.

Figure 4:
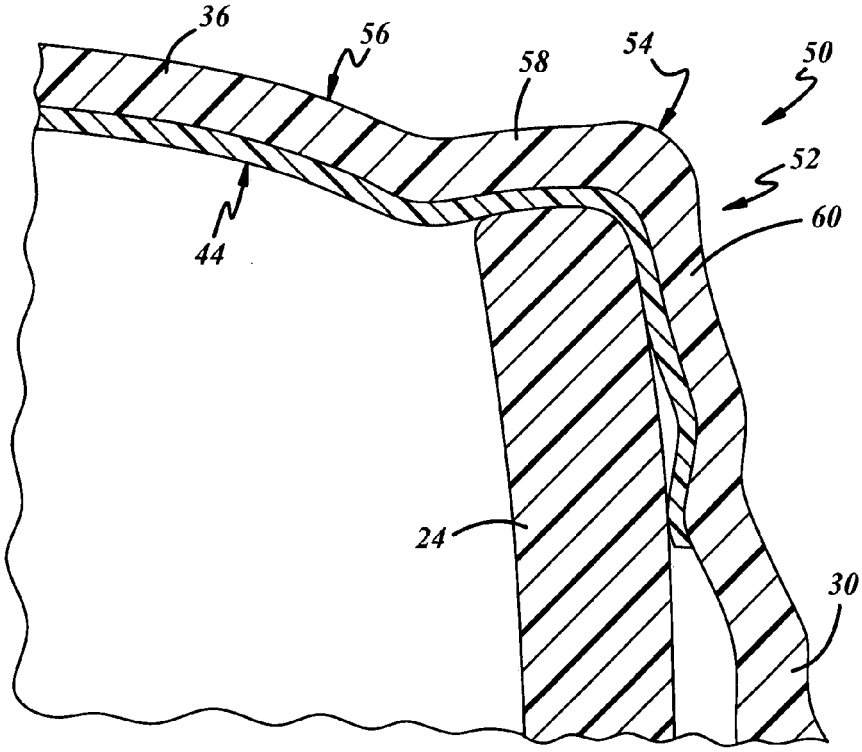
FIG. 4 is a fragmentary sectional view of a package in accordance with a second exemplary embodiment of the present disclosure.
Figure 5:
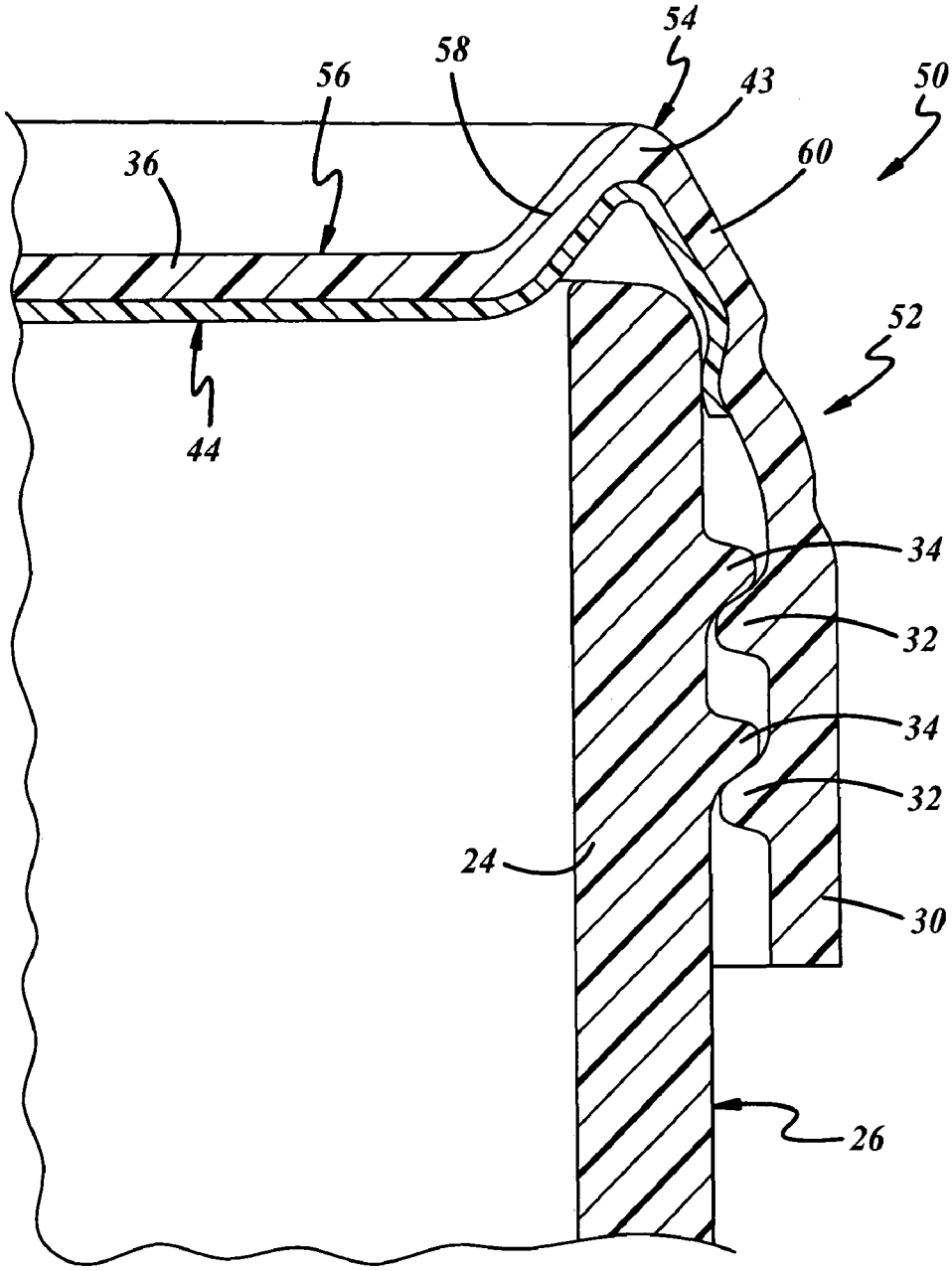
FIG. 5 is a fragmentary sectional view of the package in FIG. 4 with the closure partially threaded onto the container neck finish.

FIGS. 4 and 5 illustrate a package 50 in accordance with a second embodiment of the present disclosure as including a closure 52 applied to neck finish 24 of container 26. Reference numerals in FIGS. 4 and 5 that are identical to reference numerals in FIGS. 1-3 indicate correspondingly identical or related components. The primary difference between the embodiment of FIGS. 4-5 and the embodiment of FIGS. 1-3 is that the annular inverted V-shaped portion 54 of closure shell 56 has a conical inner leg 58 and a conical outer leg 60, which preferably are at equal and opposite angles with respect to the axis of closure skirt 30. As in the embodiment of FIGS. 1-3, threaded application of closure 52 to neck finish 24 brings inner leg 58 into engagement with the inside edge of the container neck finish. The conical geometry of outer leg 60 brings the portion of liner 44 on the inside of leg 60 into engagement with the outer edge of neck finish 24. Inner leg 58 and base wall 36 again are flexed axially outwardly around apex 43 by continued threading of closure 52 onto neck finish 24, drawing outer leg 60 and liner 44 into sealing engagement with the outer edge of neck finish 24. Outer leg 60 flexes outwardly toward a cylindrical configuration and can flex the end of neck finish 24 radially inwardly as illustrated in FIG. 4.

There thus have been disclosed a closure and a package that fully satisfy all of the objects and aims previously set forth. The closure and package provide enhanced sealing in either internal pressure or internal vacuum applications. The disclosure has been presented in conjunction with exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A closure that includes:

a plastic shell having a generally flat base wall, a peripheral skirt having at least one internal thread segment for threaded engagement with a container neck finish and an annular portion integrally connecting said skirt to a periphery of said base wall, and a flexible resilient sealing liner on at least an inner surface of said annular portion, said annular portion having an inverted V-shape with an outer leg integrally connected to said skirt and an inner leg integrally connected to said periphery of said base wall such that said base wall is disposed axially beneath an annular connection between said inner and outer legs, wherein a juncture of said inner and outer legs forms an apex of said inverted V-shape annular portion, said inner leg being resiliently flexible with respect to said outer leg upon engagement with an end of a container neck finish.

2. A closure that includes:

a plastic shell having a generally flat base wall, a peripheral skirt for mounting the closure on a container neck finish and an annular portion integrally connecting said skirt to a periphery of said base wall, and a flexible resilient sealing liner on at least an inner surface of said annular portion, said annular portion having an inverted V-shape with an outer leg integrally connected to said skirt and an inner leg integrally connected to said periphery of said base wall such that said base wall is disposed axially beneath an annular connection between said inner and outer legs, said inner leg being resiliently flexible with respect to said outer leg upon engagement with an end of a container neck finish, including an annular channel on an inside surface of said closure where said inner leg connects to said base wall, said flexible resilient liner filling said channel.

3. A closure that includes:

a plastic shell having a generally flat base wall, a peripheral skirt for mounting the closure on a container neck finish and an annular portion integrally connecting said skirt to a periphery of said base wall, and a flexible resilient sealing liner on at least an inner surface of said annular portion, said annular portion having an inverted V-shape with an outer leg integrally connected to said skirt and an inner leg integrally connected to said periphery of said base wall such that said base wall is disposed axially beneath an annular connection between said inner and outer legs, said inner leg being resiliently flexible with respect to said outer leg upon engagement with an end of a container neck finish, wherein said inner leg is conical, and wherein said outer leg is cylindrical and coaxial with said skirt.

4. The closure set forth in claim 1 wherein said inner leg is conical and wherein said outer leg is conical.

5. The closure set forth in claim 4 wherein said conical inner and outer legs are at equal and opposite angles.

6. The closure set forth in claim 1 wherein said sealing liner extends over an undersurface of said base wall.

7. A package that includes:

a container having a neck finish with an end and at least one external thread segment, and a closure that includes a one-piece plastic shell having a generally flat base wall, a peripheral skirt with at least one internal thread segment for threaded engagement with said container neck finish, an inverted V-shaped annular portion connecting said skirt to a periphery of said base wall, and a flexible resilient sealing liner on an inside surface of at least said inverted V-shaped annular portion, said inverted V-shaped annular portion having an outer leg and an inner leg for engaging said liner against an inside edge of said container neck finish as said closure is threaded onto said neck finish so as to flex said inner leg and said base wall outwardly with respect to said skirt and draw said outer leg into engagement with an outer surface of said neck finish.

8. The package set forth in claim 7 wherein said inner leg is conical.

9. The package set forth in claim 8 wherein said outer leg is cylindrical and coaxial with said skirt.

10. The package set forth in claim 8 wherein said outer leg is conical.

11. The package set forth in claim 10 wherein said conical inner and outer legs are at equal and opposite angles.

12. The package set forth in claim 7 including an annular channel on an inside surface of said closure where said inner leg connects with said base wall, said flexible resilient liner filling said channel.

13. The package set forth in claim 7 wherein said sealing liner extends over an undersurface of said base wall.

* * * * *